US007954229B1

(12) United States Patent
Thweatt, Jr.

(10) Patent No.: US 7,954,229 B1
(45) Date of Patent: Jun. 7, 2011

(54) METHOD OF FORMING A TITANIUM HEATING ELEMENT

(76) Inventor: Carlisle Thweatt, Jr., South Haven, MI (US)

( * ) Notice: Subject to any disclaimer, the term of this patent is extended or adjusted under 35 U.S.C. 154(b) by 565 days.

(21) Appl. No.: 12/185,495

(22) Filed: Aug. 4, 2008

Related U.S. Application Data

(60) Provisional application No. 60/953,846, filed on Aug. 3, 2007.

(51) Int. Cl.
*H05B 3/00* (2006.01)

(52) U.S. Cl. ..... 29/611; 29/613; 29/619

(58) Field of Classification Search ..... 29/611, 29/613, 614, 619, 621; 219/541, 546, 552, 219/618, 633; 392/465, 466, 485, 488
See application file for complete search history.

(56) References Cited

U.S. PATENT DOCUMENTS

| | | | | |
|---|---|---|---|---|
| 4,802,930 | A | 2/1989 | Kessler | |
| 5,141,565 | A | 8/1992 | Kramer et al. | |
| 5,683,607 | A | 11/1997 | Gillespie et al. | |
| 7,065,292 | B2 * | 6/2006 | Thweatt, Jr. | 392/488 |

* cited by examiner

*Primary Examiner* — Thiem Phan
(74) *Attorney, Agent, or Firm* — Carlisle Thweatt, Jr.

(57) ABSTRACT

A method of making a titanium heating element for electric water heaters includes heating commercially pure titanium tubing to a specified temperature for a predetermined period of time. A resistance wire and magnesium dioxide powder may be positioned in the tubing prior to the annealing process. The outer surfaces of the titanium tube are exposed to the air during at least a portion of the annealing process, such that a layer of titanium dioxide develops on the outer surface of the titanium. The heating element is then formed into a loop or other suitable shape, and it is positioned inside a housing. The housing may include fittings to connect the water heater to the tubing of a pool, jetted tub, spa, hot tub or the like.

14 Claims, 3 Drawing Sheets

METHOD OF FORMING A TITANIUM HEATING ELEMENT

CROSS REFERENCE TO RELATED APPLICATIONS

This application claims the benefit of U.S. Provisional Application No. 60/953,846, filed on Aug. 3, 2007, the entire contents of which are incorporated by reference.

BACKGROUND OF THE INVENTION

Various types of water heaters have been developed for use in hot tubs, swimming pools, and the like. Due to the caustic chemicals added to the water in hot tubs, pools, and the like, electric water heaters used in such applications may suffer from corrosion or other degradation.

Heating elements made of stainless steel, titanium, and other materials have been developed in an effort to provide increased durability. Heating elements used in water heaters may need to be formed into relatively complex shapes with relatively small bend radii, and forming titanium in this manner typically requires that the titanium be annealed prior to forming. Known techniques for annealing titanium may include heating the titanium in a vacuum environment to prevent corrosion on the surfaces of titanium. When used in applications requiring high strength and low weight (e.g. aerospace structures), such corrosion is undesirable due to the resulting weakness in the titanium material.

DETAILED DESCRIPTION OF PREFERRED EMBODIMENT

Figure 1:
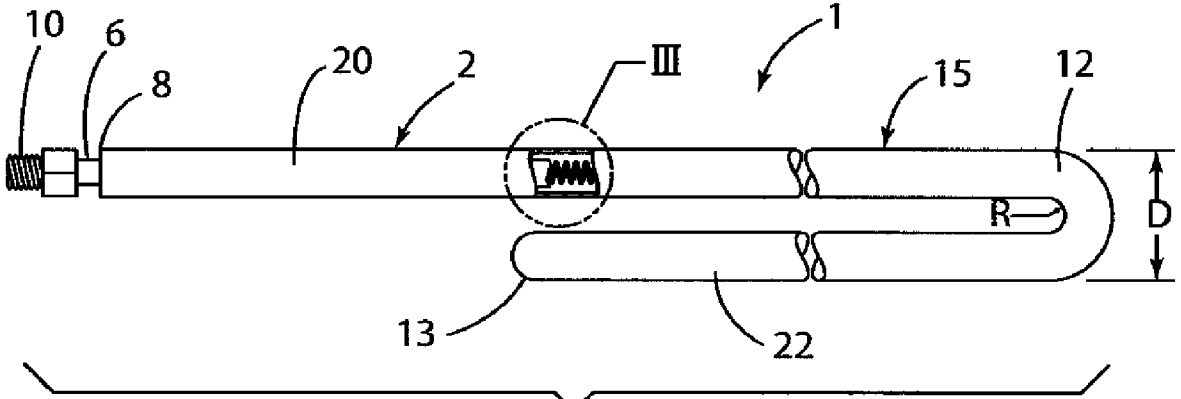
FIG. 1 is a partially fragmentary front elevational view of a heating element according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
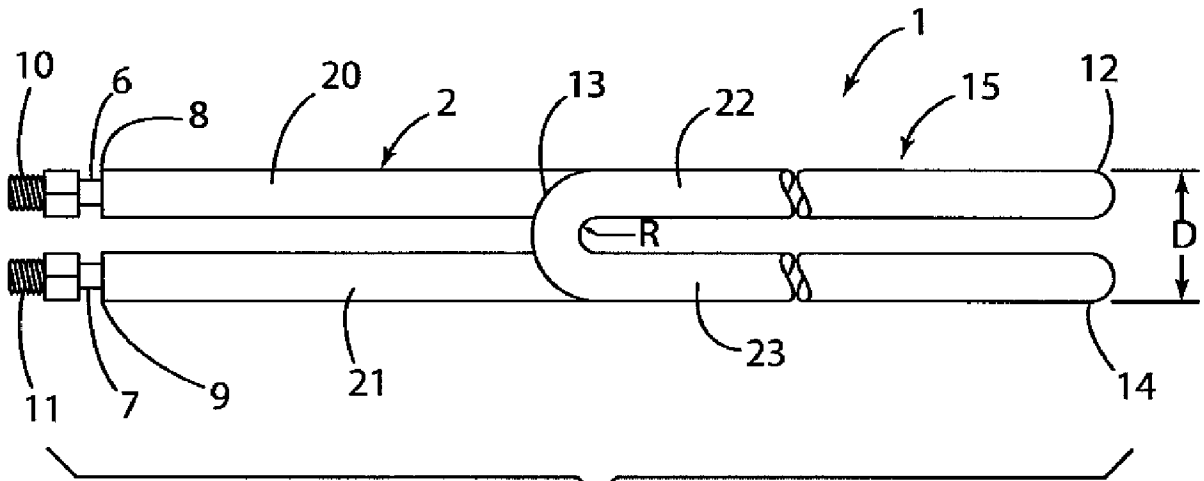
FIG. 2 is a bottom plan view of the heating element of FIG. 1.
Figure 3:
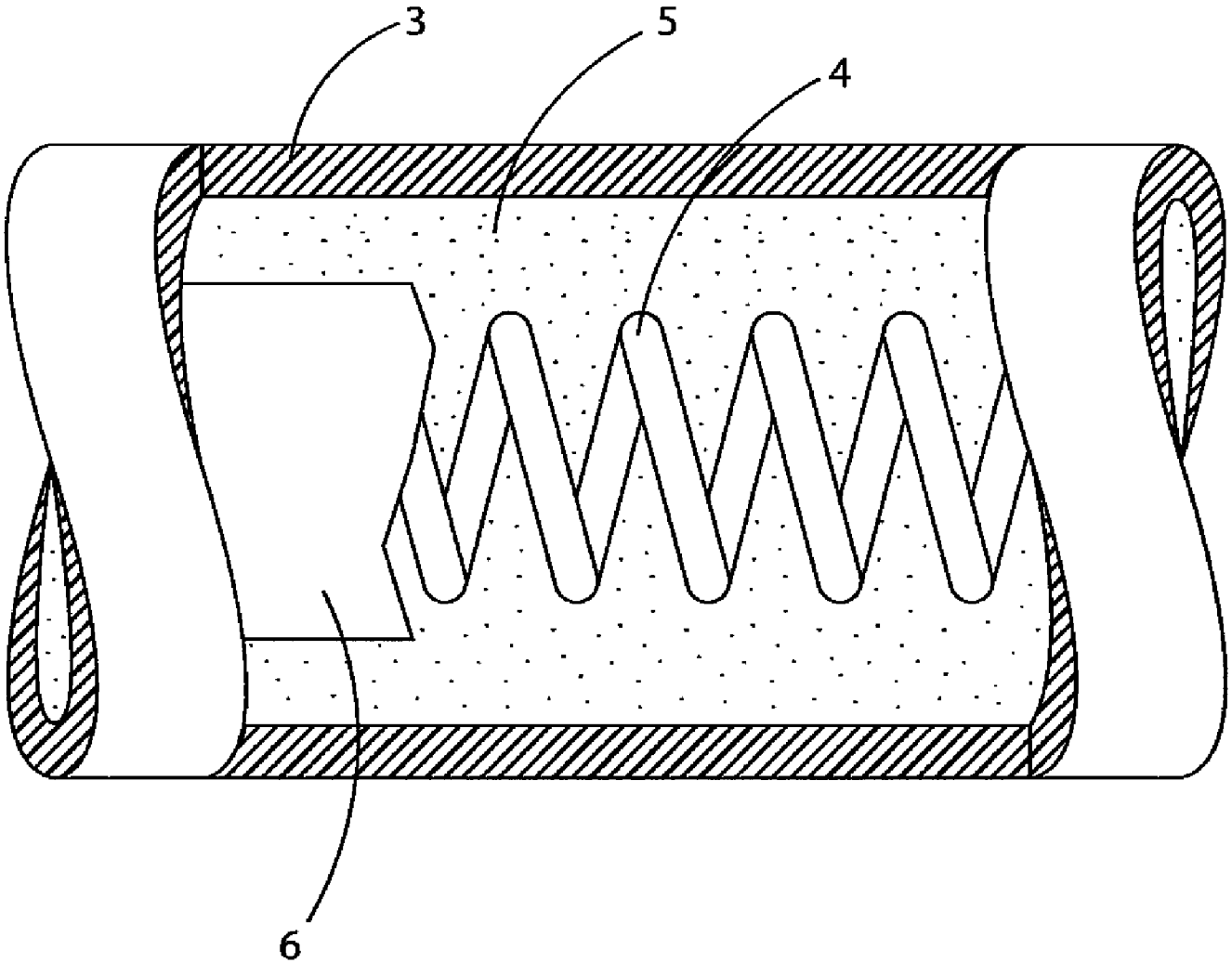
FIG. 3 is an enlarged cross-sectional view of a portion of the heating element of FIG. 1.

A heating element 1 (FIGS. 1 and 2) according to one aspect of the present invention includes an elongated body portion 2 that includes a titanium sheath 3 and a resistance wire 4 (see also FIG. 3). Magnesium dioxide powder 5 is tightly packed around the resistance wire 4 inside the titanium sheath 3 to electrically insulate the resistance wire 4 from the titanium sheath 3. The magnesium dioxide provides for transfer of heat from the resistance wire 4 to the titanium sheath 3. The titanium sheath 3 can be roll-reduced to compact the magnesium dioxide powder 5 according to known methods. Cold pins 6 and 7 protrude from ends 8 and 9, respectively, of the body portion 2 and electrically connect the resistance wire 4 to threaded connectors 10 and 11, respectively. The ends 8 and 9 may be sealed using epoxy or other suitable material to prevent entry of moisture or other foreign matter into the area inside the titanium sheath 3.

The heating element 1 may be utilized in a variety of different types of heaters. In particular, heating element 1 may be used with water heaters having a titanium manifold/housing as disclosed in U.S. Pat. No. 6,873,793, or it may be used with heaters having a polymer housing as disclosed in U.S. Pat. No. 6,621,985. The entire contents of each of these patents are hereby incorporated by reference. If heating element 1 is used with a titanium manifold/housing, the element 1 may be welded to the manifold/housing adjacent ends 8 and 9 to provide a water tight connection.

In the illustrated example, the titanium sheath 3 has a tubular-type construction with a diameter of 0.260 inches, and a wall thickness of about 0.020 inches±0.002 inches. Heating element 1 includes bends 12, 13 and 14 having an inner radius "R" of 3⁄32 inches. The dimensions "D" of end portion 15 of heating element 1 are 23⁄32 inches. It will be understood that heating element 1 may have a variety of shapes, sizes, and configurations as required for a particular application, and the dimensions and curvatures shown are not to be construed to be limitations unless expressly stated as such in the claims. Specifically, the heating element 1 may have the same shape and size as the heating elements shown in above-identified U.S. Pat. Nos. 6,873,793 and 6,621,985, and it may be assembled to housings as shown in these patents. The titanium sheath may also have other diameters and/or thicknesses. For example, titanium tubing utilized to form sheath 3 may have a nominal diameter of 0.315 inches, 0.430 inches, or other suitable sizes, and it may have a thickness of 0.020 inches, 0.28 inches, 0.35 inches, 0.049 inches, or other suitable thickness. The titanium sheath 3 may be made from "commercially pure" titanium that is preferably at least about 99 percent titanium. Examples of such material are a grade 1 or grade 2 titanium alloy having UNS designations R50250 and R50400, respectively. Although other grades of commercially pure titanium may also be utilized, in general, grade 1 and grade 2 titanium are more preferred due to the increased difficulty forming higher grades of commercially pure titanium. Suitable commercially pure titanium is available from, for example, ATI Allegheny Ludlum Corporation of Brackenridge, Pa.

During fabrication of heating element 1, the resistance wire 4 and magnesium dioxide powder 5 (FIG. 3) are positioned in the tubing prior to annealing and forming, and the tubing is then processed in a rolling mill to compact the Magnesium Dioxide powder 5 around the resistance wire 4. The titanium material used to form titanium sheath 3 is then annealed to provide for deforming the material to form the bends 12-14 without fracturing the material. In a preferred embodiment, the titanium material is annealed in an oven for 60 minutes at a temperature of 1250° F. (see also point "C", FIG. 4). The titanium material is exposed to ambient air during the annealing process, such that a layer of oxidation tends to form on the surface of the titanium sheath 3. This layer of oxidation is relatively thin, however, such that the strength of the titanium sheath 3 is not excessively degraded. The titanium sheath 3 may be selectively annealed only in regions that are later deformed to form bends 12-14, such that straight portions 20-23 remain relatively hard. Selected regions of the titanium sheath 3 can be annealed using a flame/torch. The sheath 3 may be positioned on a moving conveyor and the temperature and size (e.g., width) of the flame can be adjusted to provide the desired annealing process at selected portions of the sheath 3.

Depending upon the size of the radius "R" (FIGS. 1 and 2) required for a particular heating element 1, the bend may be formed in steps wherein the titanium sheath 3 is annealed, deformed partially, annealed again, and further deformed. If required, a portion of the titanium sheath 3 may be annealed and deformed two, three, four, or more times until the desired final radius "R" is achieved. In some cases, the radius "R" may be extremely small, or zero, such that straight portions of the sheath 3 adjacent the bend are in contact with one another, or very close to being in contact. In such cases, the final forming process may be a "repress" wherein the adjacent portions of the sheath 3 are pressed together using a "paddle". The paddle may be rubber, wood, or other soft material. The use of paddles and pressing to form tubes is generally known in the art, such that the details of this portion of the process will not be described in detail herein.

Annealing of the titanium tubing permits forming sheath 3 to provide a small bend radius. If the bend radius is large compared to the diameter of the tubing, it may be possible to form the tubing without annealing. In general, if the bend radius is less than about three to four times the diameter of the titanium tubing, annealing will facilitate forming of the tubing. Annealing of the titanium tubing permits bends having a radius of two times the diameter of the tubing or less (e.g. zero) to be formed.

Figure 4:
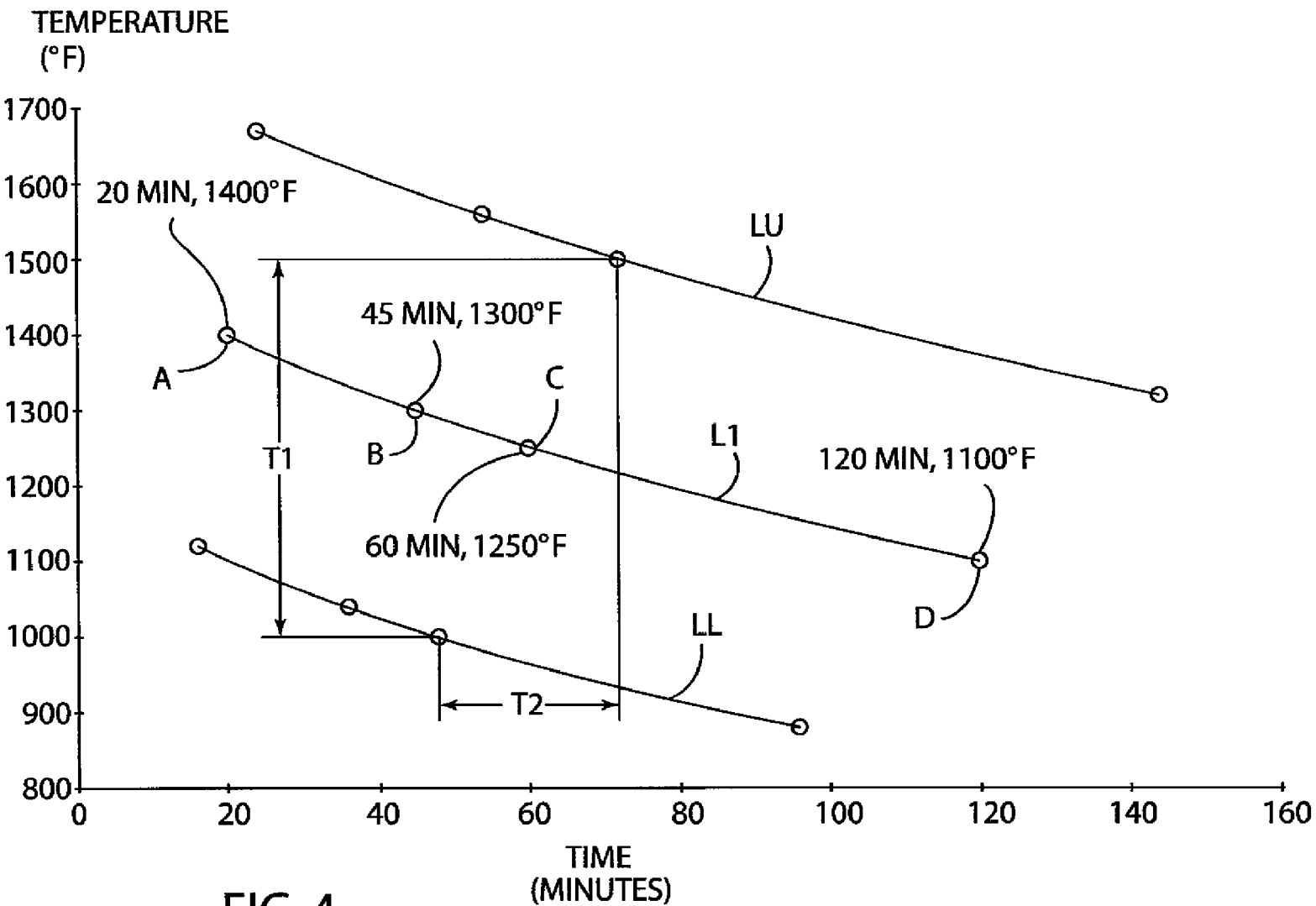
FIG. 4 is a graph illustrating times and temperatures for annealing titanium according to one aspect of the present invention.

With further reference to FIG. 4, alternate annealing schedules other than point "A" may also be utilized to anneal the titanium sheath 3. For example, the sheath 3 (or portions thereof) may be held at 1400° F. for 20 minutes (point "A"), or it may be held at 1300° F. to 45 minutes (point "B"), or it may be held at 1100° F. for 120 minutes (point "D"). These times and temperatures can be plotted as shown in FIG. 4. In general, the times and temperatures can vary at least about 20 percent from these amounts without adversely affecting the formability of the titanium sheath 3 to an excessive degree. For example, the data point "C" of FIG. 4 corresponds to 60 minutes at 1250° F. The temperature at point "C" may vary above or below 1250° F. by 20 percent, such that the temperature "T1" may vary from 1000° F. to 1500° F. Similarly, the time may also vary by ±20 percent to form a range "T2" from 48 minutes to 72 minutes. The line "L1" of FIG. 4 represents a preferred time and temperature, the line "LU" represents the upper bound for the time and temperature at a given point, and the line "LL" represents the lower bound for the time and temperature for the anneal process if the time and temperature are varied by ±20 percent. It will be understood that satisfactory results may, in some cases, be obtained even if a combination of time and temperature outside the upper line "LU" or lower line "LL" is utilized. Nevertheless, the combinations of time and temperatures bound by the lines "L" have generally been found to provide the best results with respect to formability of the titanium sheath material.

Although the titanium may be annealed at a substantially constant temperature for a selected period of time, the titanium could also be annealed at a variable temperature, and the length of time required could be adjusted accordingly to account for the varying temperature. For example, the temperature could be varied in a periodic manner (e.g. sinusoidally) every ten minutes from a minimum temperature of 1100° F. to a maximum temperature of 1400° F., with an average temperature of 1250° F. In this example, the titanium may be annealed for 60 minutes, a preferred time period for a substantially constant annealing temperature of 1250° F. Similarly, the titanium could be annealed at starting temperature of 1400° F., and the temperature may be gradually decreased (e.g. linearly) from 1400° F. to 1100° F. In this example, the titanium may be annealed for 60 minutes, corresponding to the "average" temperature of 1250° F. Alternately, the titanium could be annealed at a starting temperature of 1100° F. and gradually raised to 1400° F. It will be readily apparent that either annealing processes utilizing other variations of time and temperature could also be utilized.

The titanium tubing utilized to form sheath 3 may be welded or extruded, and typically has a nominal outer diameter in the range of about 0.250 inches to about 0.430 inches, with a nominal wall thickness in the range of about 0.020 inches to about 0.049 inches. Commercially available tubing typically has a tolerance of +0.002 inches, such that the actual wall thickness may vary from about 0.018 inches to about 0.051 inches. However, in general, the wall thickness could be as small as 0.017 inches, the minimum thickness required by the applicable code for electric water heaters. Although other tubing sizes may be utilized, these tubing sizes are suitable for forming electric water heaters for spas, pools and the like wherein the bend radii "R" (FIGS. 1 and 2) may be 0.50 inches, 0.25 inches, 0.125 inches, or less (e.g. 3/32 inches, or zero).

Annealing of the titanium sheath 3 permits deforming of the sheath 3 to form bends 12-14 to form a very compact unit having minimal external dimensions. Furthermore, the annealing process described above is very cost-effective because it does not require utilizing procedures to prevent formation of oxidation.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A method of forming a titanium heating element, the method comprising:

providing titanium tubing made of commercially pure titanium comprising at least about 99 percent titanium by weight, wherein the tubing has an outer diameter in the range of about 0.260 inches to about 0.430 inches and a wall thickness of about 0.017 inches to about 0.035 inches;

positioning an electrical resistance wire and dielectric material inside the titanium tubing, with the dielectric material electrically insulating the electrical resistance wire from the tubing;

annealing the titanium at a temperature sufficient to permit bending of the tubing to firm a radius of about 0.50 inches or less; and wherein:

the titanium is exposed to air during the annealing process and forms at least a partial layer of titanium oxide on an outer surface of the tubing.

2. The method of claim 1, wherein:

the tubing comprises UNS R50250 grade 1 titanium.

3. The method of claim 1, wherein:

the tubing has a wall thickness of about 0.018 inches to about 0.022 inches.

4. The method of claim 3, wherein:

the tubing has an outer diameter of about 0.315 inches.

5. The method of claim 1, wherein:

the titanium tubing includes generally straight portions that are formed adjacent the bend to form an elongated U-shaped portion.

6. The method of claim 5, wherein:

the straight portions are substantially parallel to one another.

7. The method of claim 6, wherein:

the titanium tubing includes a plurality of bends forming a plurality of elongated U-shaped portions.

8. The method of claim 7, wherein:

the titanium tubing includes three bends and four straight portions, and wherein the four straight portions are substantially parallel to one another.

9. The method of claim 1, wherein:

the titanium tubing is formed into a bend by annealing and forming the titanium a plurality of times.

10. The method of claim 9, wherein:

the titanium tubing is formed to provide a bend of about one hundred and eighty degrees with generally straight portions of the titanium tubing disposed adjacent the bend.

11. The method of claim 10, wherein:

the bend has a radius of three thirty seconds of an inch or less.

12. The method of claim 11, wherein:

the bend has a radius that is substantially zero inches.

13. The method of claim 1, wherein:

the titanium tubing is annealed at a temperature in the range of about 1000° F. to about 1500° F., for a time in the range of about 48 minutes to about 72 minutes.

14. The method of claim 13, wherein:

the titanium tubing is annealed at about 1250° F. for about 60 minutes.

* * * * *